United States Patent [19]

Tomaro

[11] 3,963,179

[45] June 15, 1976

[54] SHOWER HEAD ADAPTED TO PRODUCE STEADY OR PULSATING FLOWS

[75] Inventor: Patrick M. Tomaro, Maplewood, N.J.

[73] Assignee: Continental Hair Products, Inc., Edison, N.J.

[22] Filed: Sept. 19, 1975

[21] Appl. No.: 614,937

[52] U.S. Cl. ..... 239/101; 239/102; 239/381; 239/447; 239/449

[51] Int. Cl.[2] ..... B05B 1/08

[58] Field of Search ..... 239/101, 102, 380–383, 239/443, 444, 446, 447, 448, 449

[56] References Cited

UNITED STATES PATENTS

| | | | |
|---|---|---|---|
| 1,609,047 | 11/1926 | Beale | 239/383 |
| 2,878,066 | 3/1959 | Erwin | 239/383 |
| 3,473,736 | 10/1969 | Heitzman | 239/101 |
| 3,568,716 | 3/1971 | Heitzman | 239/383 X |
| 3,801,019 | 4/1974 | Trenary et al. | 239/102 X |
| 3,920,185 | 11/1975 | Kwok | 239/102 |

*Primary Examiner*—John J. Love
*Attorney, Agent, or Firm*—Haynes N. Johnson

[57] ABSTRACT

A shower head is provided which can, alternatively, provide a fine, steady stream of shower water or a coarser, pulsating stream of shower water to produce a massaging effect. All of the water stream is, initially, pulsed, but the pulsation is removed when a steady stream is desired.

The incoming water enters the spinner of a Hero's engine axially; it causes rotation of the engine spinner as it leaves the tangentially directed exit spouts of the engine. The water then enters a chamber having a circular outlet cover plate carrying small peripheral holes and larger, more centrally located holes inside the periphery.

A rotatable dial plate is positioned between the circular outer cover plate and the plenum chamber. This plate has holes in it which can be aligned with the large inner massaging holes, with channels leading to the outer peripheral holes, or at a position in between. The position of the dial plate is controlled by an associated control arm. Thus, the position of the holes used differs between the type of spray desired, i.e., steady or massaging.

A cutting vane rotates with the engine spinner and "chops" the water before it passes through the holes in the dial plate. If the water then goes out to larger holes, it is pulsing and so gives a massage effect. If it passes through the channels to the peripheral holes, there is an averaging effect, and the pulsation is substantially removed by the time the water leaves the peripheral holes.

The control arm is held in position by a spring-pressed washer which allows it to be removed slightly from the cover to have a U-shaped brush slipped between the cover and the control arm for use in washing.

18 Claims, 8 Drawing Figures

Fig. 7.
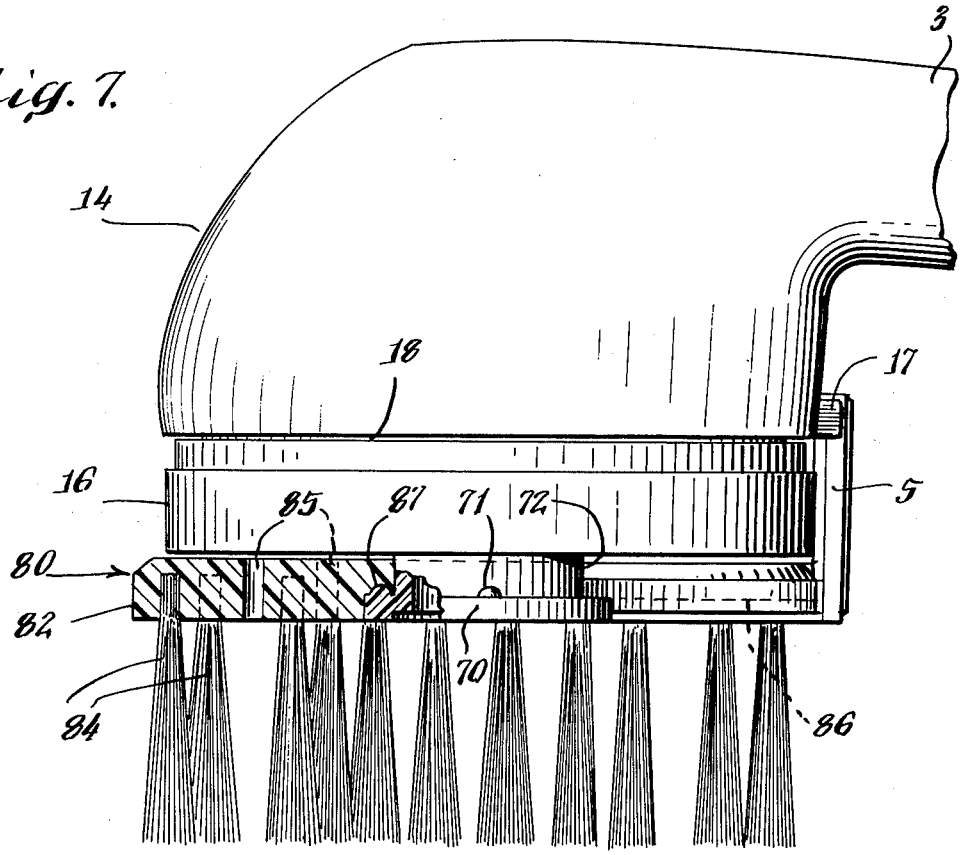
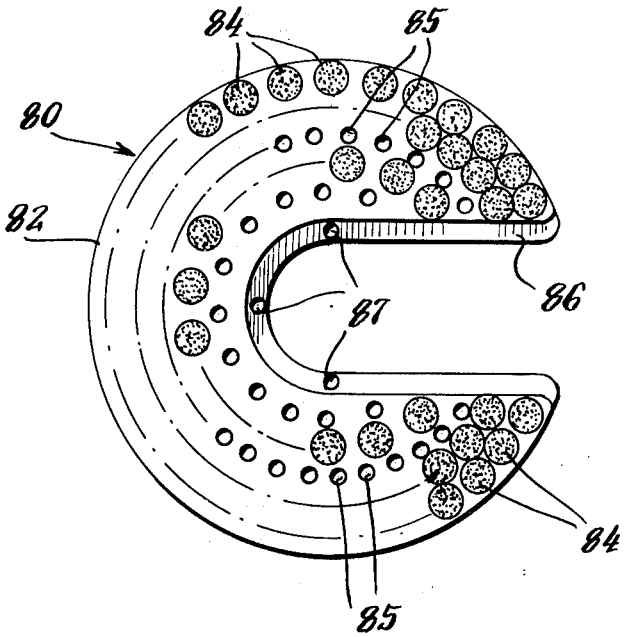
Fig. 8.

SHOWER HEAD ADAPTED TO PRODUCE STEADY OR PULSATING FLOWS

BACKGROUND OF THE INVENTION

It has become popular to provide shower heads which can be used either as a normal shower head or as a massaging type shower head. In designing such a shower head, it is necessary to have some method of "chopping" the stream of water to give the pulsating effect and the chopped stream of water should be emitted from the shower head through relatively large holes to produce "bulk" in the pulsed water and, therefore, a better massage type feeling. The shower head should also have a steady-stream alternate flow; there the water preferably passes through small holes to give a finer stream. Thus, it is better to have two sets of outlet holes and some control means for directing the stream of water to one or the other of the sets. In addition, there should be some method of "chopping" the water passing out of the larger holes.

The prior art patents include a series of designs. One approach is to direct the incoming water to different flow passages to provide two flows of water. One flow goes through the chopping blade of a turbine, and the other by-passes the chopping blade and is a steady-state flow. The nature of the outlet water flow is determined by controlling the amount of flow through the passages. Examples of such patents are Deines U.S. Pat. No. 3,762,648 and Trenary 3,801,019.

Another approach is to divide all the water into two paths, one through a cylindrical chopping unit operated by a turbine and the other through a by-pass. The water then goes through a valve controlling the output from the paths and then into a plenum chamber and to outlets. All of the water, whether pulsed or steady, passes through the same outlet openings. Examples of this are found in Heitzman U.S. Pat. Nos. 3,568,716 and 3,473,736.

Other approaches include simple use of a water operated turbine to operate a chopping blade, as in Erwin U.S. Pat. No. 2,878,066 and Lauder U.S. Pat. No. 1,101,804; use of oscillating inner plates to cause pulsation, as in Bruno U.S. Pat. No. 3,734,410, and use of fluidic "flip-flop" oscillation, as in Bauer U.S. Pat. Nos. 3,563,462, 3,741,481 and 3,770,200.

The present invention pulses all the incoming water, avoids the necessity of by-pass passages, and yet results in a shower having both pulsing and steady spray.

SUMMARY OF THE INVENTION

This invention provides a shower head which can deliver either a pulsating spray, through relatively large holes, or a steady spray through a series of smaller holes. The shower head avoids the necessity of two sets of water passages, one for steady state water flow and the other for flow going through a chopping vane (to create pulsations) since all of the water is pulsed initially, but the pulse is smoothed to a substantially steady flow when no pulsing or massaging effect is desired by the user.

To accomplish this, all of the water enters the housing of the shower head through a common opening which operates a spinner or turbine connected to chopping blades. The spinner is of the type known as a Hero's engine, and the water enters through the center of the engine, i.e., the axis, and leaves through tangentially positioned spouts which cause the engine to rotate. At the base of the spinner are some chopping blades or vanes which are rotated by the spinner.

All of the water which enters the shower head must pass through the spinner and then into a chamber. In order to leave the chamber, all of it must pass through the chopper blades and, therefore, be pulsed. Were this pulsed water then to be emitted from the shower head, it would produce the desired massaging effect.

In the shower head of the present design, however, the pulsed water is allowed to pass directly out some relatively large holes in the outlet plate, to give the massaging effect, or is directed through a smoothing channel to a series of smaller peripheral holes. It has been found that if the water goes to the peripheral holes through channels of increasing size the pulsations are averaged out and the water leaving the peripheral holes is a steady stream, not pulsating.

A dial plate, for control, is located between the chopper blade and the shower head outlet holes. This dial plate serves, depending upon its position, to permit the water to flow directly out the large outlet holes in a pulsating stream or to flow through a smoothing channel formed between the dial plate and the outlet plate to the peripheral holes. A control arm is secured to the dial plate to allow the user to rotate the dial plate to the desired position. If the dial plate is in an in-between position, a combination of steady state and pulsing shower head output will result.

The control arm is secured to the dial plate along its axis. It is held in position by a spring-pressed washer. Consequently, a U-shaped massage brush may be slipped under shoulders of the control arm to permit the shower head to be used as a massaging brush.

THE DRAWINGS

FIG. 7 is a perspective view of the shower head with the massage brush attached.

FIG. 8 is a bottom view of the massage brush removed from the shower head, showing its generally U-shaped configuration.

DETAILED DESCRIPTION OF THE INVENTION

Figure 1:
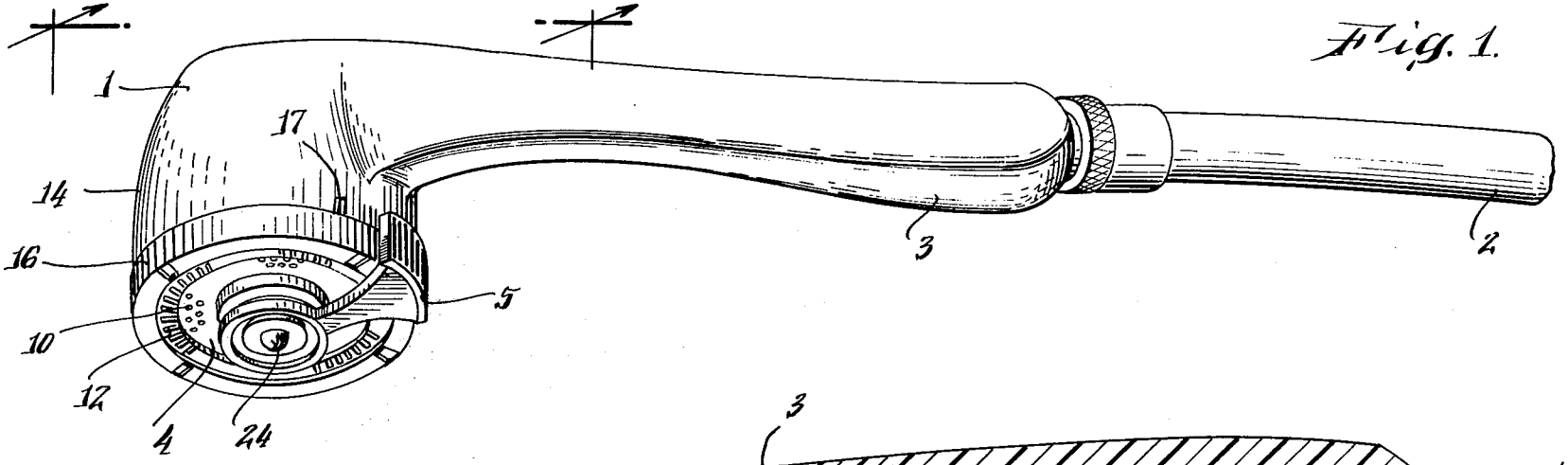
FIG. 1 is a perspective view of the shower head of the invention. It is shown as a hand-held type of unit, though it could also be fixedly mounted in a shower stall.

The shower head of the invention is identified generally by the numeral 1 in FIG. 1. It includes a water inlet hose 2, a handle 3, and a face plate or outer cover having water outlet holes. The control handle 5 controls the flow by being rotated approximately 45° back and forth, i.e., in one position there is a steady state flow from holes in the outer cover 4 and in the other position there is a pulsing flow. In intermediate positions, the flow will be a combination of steady state and pulsing.

Face plate 4 is round and includes four groups of relatively large outlet openings 10 through which the pulsating stream passes, the four groups being 90° apart. Plate 4 also includes a series of smaller peripheral holes 12 through which the steady state flow passes. Plate 4 is held in position on a housing 14 by a retaining cup or ring 16. A ring-shaped seal 18 fits between retaining cup 16 and housing 14.

Figure 2:
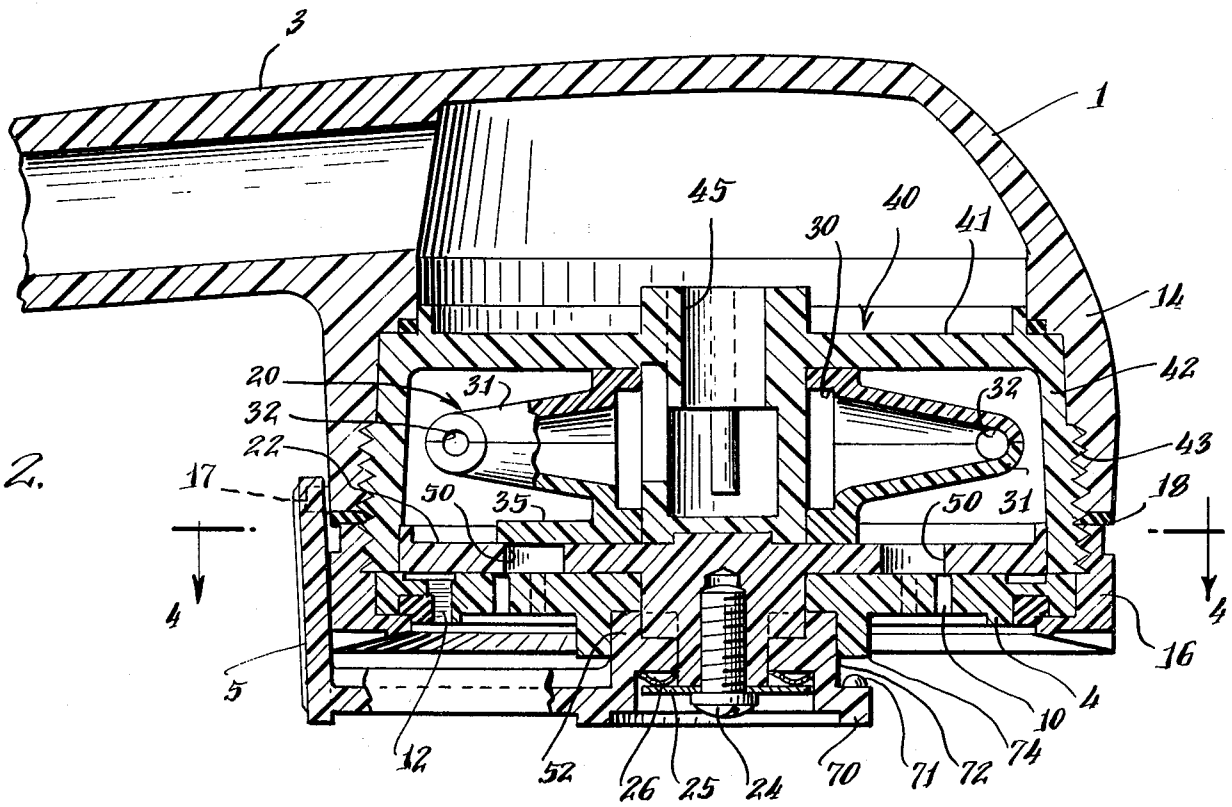
FIG. 2 is a cross-sectional view of the shower head (taken on line 1—1 of FIG. 1). It shows the inlet for the water, the spinner engine, chopping vanes, the dial plate, and exit openings.
Figure 6:
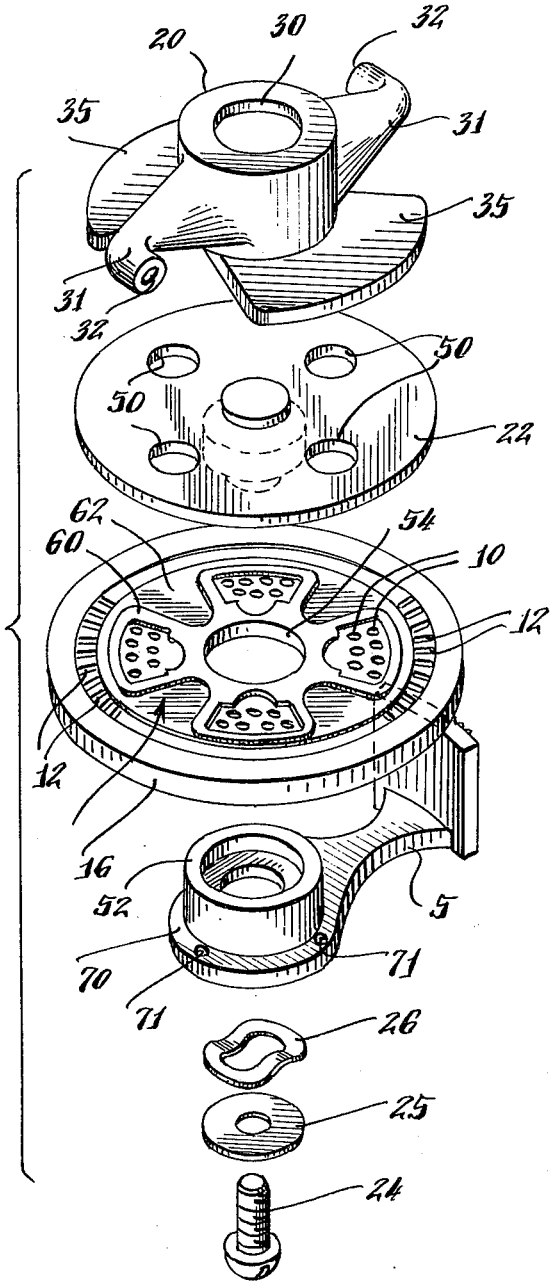
FIG. 6 is an exploded perspective view of the internal workings of the unit.

The various elements of the structure are shown in the figures. The operating features are best shown, however, in the exploded view of FIG. 6. In viewing FIG. 6 from top to bottom the parts are the spinner or Hero's engine 20 with chopping vanes 35, the dial plate 22 used for determining the type of outlet flow, the outer cover or face plate 4 and retaining cup 16 which together make the outlet face, the control arm 5, and the means for securing the control arm 5 to dial plate 22, including bolt 24, washer 25 and spring washer 26. Spinner 20 is in a chamber 40 (FIG. 2).

Spinner 20 (FIGS. 6 and 2) was designed to be mounted for rotational movement. It includes an axially located water inlet 30, two extending arms 31, and tangential outlets 32 on arms 31. All of the water which enters the shower head 1 through hose 2 and handle 3 passes through inlet 30 and out arms 31 through outlets 32. Since the water exits through outlets 32 in a direction generally perpendicular to the radius of spinner 20, i.e., tangential, it causes rotation of spinner 20. As viewed in FIG. 6, the spinner will rotate in a clockwise direction.

Spinner 20 includes two cutting vanes or choppers 35. Vanes 35 are positioned on opposite sides of the lower portion of spinner 20. Preferably they each are 90° of a circle and are opposite one another on spinner 20. Spinner 20 is mounted in an inlet chamber 40 (FIG. 2) which is generally cylindrical having a top wall 41 and a cylindrical side 42. Side 42 is threaded at 43 to engage with corresponding threads on the inner portion of housing 14. Inlet chamber 40 includes a hub 45 which fits within the inlet 30 of spinner 20 to provide an axle for rotation of the spinner.

As can be seen, all the water entering the shower head enters inlet chamber 40 (after passing through inlet 30 and out exit ports 32). Thus, all of the water that leaves the shower head will have passed through inlet chamber 40.

Positioned between chamber 40 (which is open on the exit side) is dial plate 22. Dial plate 22 is mounted for rotation across the bottom portion of the inlet chamber 40. Dial plate 22 includes control openings 50. The openings may take various forms but preferably are four large single holes 90° apart, spaced away from the periphery of plate 22 and relatively near the center of the plate. They are so positioned that, when dial plate 22 is rotated to the proper position, control openings 50 will be positioned directly over the enlarged outlet openings 10 of outer cover 4. Thus, it can be seen that in this position water from inlet chamber 40 will pass through holes 50 and directly out the large outlet holes 10. It will also be seen, however, that, since spinner 20 is constantly rotating, vanes 35 will periodically chop off or interrupt the flow of water through holes 50 thus causing all the water coming out of holes 10 to be pulsed, giving a massaging type effect.

Dial plate 22 is secured to the central hub 52 of control arm 5 by means of bolt 24, washer 25 and spring washer 26. Hub 52 passes through an opening 54 in the center of outer cover 4 in order to be secured to dial plate 22. Consequently, rotation of control arm 5 will correspondingly rotate dial plate 22.

Regardless of the angular position of dial plate 22, all of the water leaving inlet chamber 40 must pass through holes 50 in dial plate 22. Since all of the water passing through 50 is chopped by vanes 35, all of the water leaving chamber 40 will be pulsating.

The inner surface of the face plate 4 has a series of raised portions or ribs 60 surrounding the holes 10. Ribs 60 are contiguous with the under surface of dial plate 22. As a result, when holes 50 of dial plate 22 are aligned with large holes 10 all of the water which passes through holes 50 goes out the more centrally located holes 10, i.e., all of the water leaving the shower head unit leaves through holes 10 in a pulsating fashion.

Ribs 60 define a series of radial channels 62 between holes 10, one channel between each pair of ribs 60. The lower portion of channels 62 is defined by the inner surface of cover plate 4, and the upper portion by the lower surface of dial plate 22. Channels 62 lead to the small peripheral outlet openings 12. Thus, when the holes 50 of dial plate 22 are positioned over channels 62, the water flows from the inlet chamber 40 through holes 50 into channels 62 and out peripheral holes 12.

The flow distance in channels 62 from the holes 50 to peripheral holes 12 is considerably greater than the distance between holes 50 and the larger outlet holes 10, and the channels have an increasing cross-sectional area, i.e., diverge. Consequently, as the water passes through channels 62, the pulsation tends to smooth or average out (even though the water that enters holes 50 and then goes into channels 62 is pulsed by vanes 35). This smoothing effect substantially reduces or eliminates any pulsation of the water leaving holes 12. Thus, when dial plate 22 has its openings 50 over channels 62, no water passes through holes 10 in cover plate 4, and all of the water exits through the smaller peripheral holes 12 in a more or less steady state.

If dial plate 22 is positioned so that holes 50 allow a portion of the water to enter channels 62 and a portion to go directly to holes 10, then the exiting water will be partially pulsing (from the center portions) and partially steady (from the outer portions).

Retaining cup 16 includes a pair of stops 17 on the periphery of housing 14. These serve to limit the motion of control arm 5 to 45°, from the position in which dial plate 22 has its opening 50 directing all the water to the large outer cover openings 10 to, at the other extreme position, channels 62 and small peripheral openings 12.

It should be noted that use of the inlet chamber results in substantial consistency of flow through holes 50, i.e., no one hole is favored over any other. Thus the output flow is generally uniform throughout the spray head.

Figure 3:
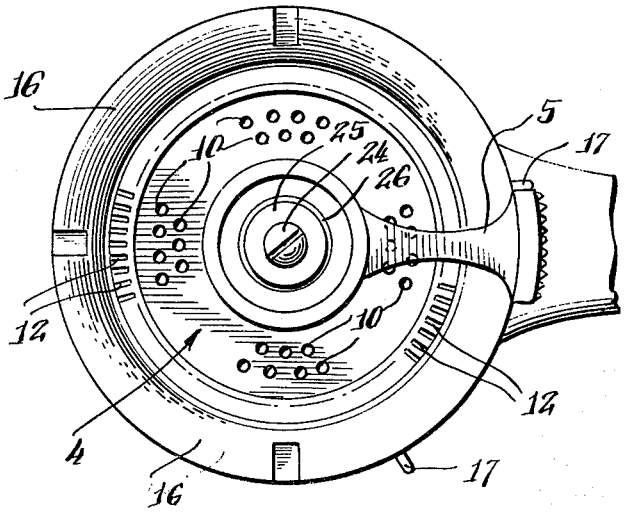
FIG. 3 is a view looking directly at the face of the shower head outlet and shows the outlet holes and the control arm.
Figure 4:
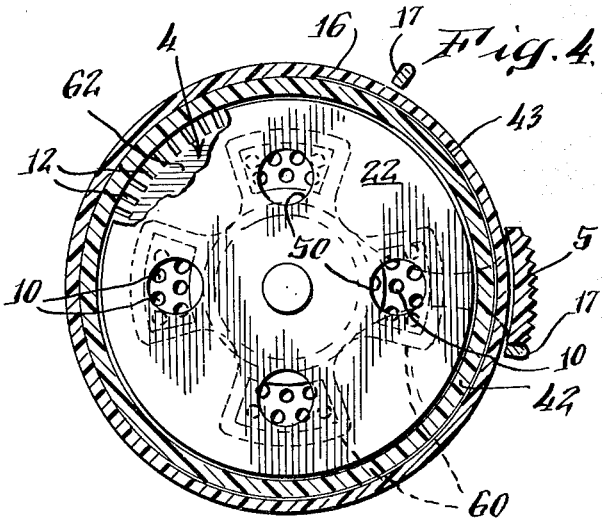
FIGS. 4 and 5 are similar to FIG. 3 but as viewed from inside (they are sections taken on line 4—4 of FIG. 2). They show the operation of the unit with the control arm in different positions.
Figure 5:
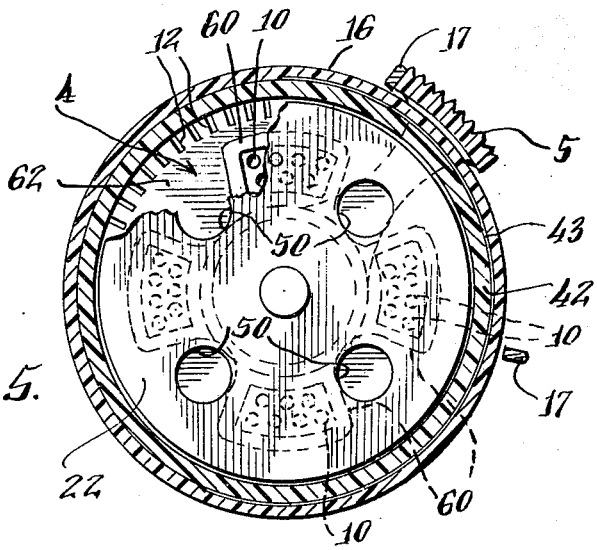

FIG. 3 is a view of the shower head looking directly at its outlet face. It shows the larger outer holes 10 for pulsating water and the smaller peripheral holes 12 for steady stream water. FIGS. 4 and 5 are the same as FIG. 3, but are a view from the inside of the unit. They show water flow paths for two different positions of control arm 5.

In FIG. 4, arm 5 is positioned so that holes 50 in dial plate 22 are aligned with large outlet holes 10. This results in a pulsed stream. In FIG. 5, arm 5 is positioned so that holes 50 are not aligned with holes 10, so the water passes through channels 62 to the peripheral holes 12. This results in a steady stream.

As mentioned above, control arm 5 is connected to dial plate 22 through hub 52, bolt 24, washers 25 and spring washer 26. Control arm 5 may, therefore, be moved a small distance axially in the direction away from outer cover 4. Control arm 5 has an extending flange 70 on the outer side of its hub 52. This flange is so positioned as to leave a small gap 72 (FIG. 2) between flange 70 and the inner portion or shoulder 74 of cover plate 4. This gap is to receive a massage brush 80 (FIGS. 7 and 8).

Massage brush 80 is made up of flat base portion 82 with a series of embedded bristles 84. Base portion 82 includes a U-shaped opening 86 sized to fit about hub 52 of control arm 5 and to fit within space 72 inside flange 70. If desired, base 82 may also have openings 87 around the internal periphery of U-shaped opening 86 positioned to receive detents 71 on the inner surface of flange 70.

Brush 80 includes a series of holes 85 in base 82 which are positioned so that the shower head may be used with the brush in position. This may be done either by aligning the holes with ones in face plate 4 or having them slightly spaced from the plate.

To position the brush, U-shaped opening 86 is pressed around hub 52 and under flange 70 until detents 71 align with openings 87. Since hub 52 and flange 70 are spring pressed inwardly by spring washer 26, brush 80 will be held in position in front of face plate 4 with the inner portion of U-shaped opening 86 fitting within the space 72.

The shower head may be made of plastic or metallic parts as may be desired.

OPERATION

To operate the shower head, the water is turned on (valve not shown), and water flows through hose 2 and handle 3 to axial inlet 30 of spinner 20. It then passes through arms 31 to outlets 32, causing rotation of the spinner and enters chamber 40.

The water in chamber 40 is not pulsating, and due to the motion of arms 31, is relatively uniformly distributed through chamber 40.

The water then goes through holes 50 in dial plate 22. It is at that time chopped by vanes 35 on spinner 20, so that all the water entering holes 50 is pulsating (regardless of the position of dial plate 22).

The user may elect to receive either a pulsed stream through large openings 10 or a steady stream through the peripheral holes 12. If the former is desired, control arm 5 is moved to a position such that holes 50 in dial plate 22 are in line with holes 10, so the pulsating water passes directly out face plate 4. If a steady stream is desired, control arm 5 is moved so that holes 50 are in line with channels 62. The water will then flow to the smaller, peripheral holes 12.

Flow of water through channels 62 serves to average or "de-pulse" it. This would appear to occur as a result of the generally expanding cross-sectional area of channels 62. The averaging may be aided by the back pressure caused by the smaller outlet hole size and wall friction in the channels. The water travel distance from chopper vanes 35 to exit holes 12 should be sufficient, in view of overall structural dimensions, to remove or substantially eliminate the pulses.

If desired, a mixture of pulsed and steady water stream may be had by placing the control arm in an intermediate position.

In order to use the brush 80, one simply slips the opening 86 of the brush under flange 70 on the control arm and the brush will be held in position. Water, pulsing or steady, as desired, will pass through the holes 85 in the brush while it is being used.

I claim:

1. A shower head capable of alternately dispensing a fine, steady stream and a heavier, pulsating stream with a massaging effect, including a housing having a water inlet and a water outlet, a face plate covering said outlet, said face plate being generally circular and including an outer peripheral set of fine outlet holes and an inner set of larger outlet holes, said plate including at least one radial, pulse-averaging channel leading to said fine outlet holes, a rotatable dial plate within said housing and contiguous with said outer cover, said dial plate having openings therein positioned to be in alignment with said channel when in one rotative position and with said larger holes when in a different rotative position, and means associated with said dial plate for rotating same from one position to the other, an inlet chamber within said housing, said chamber being formed by said dial plate, sides, and an upper wall portion, said upper wall portion having a central opening therein to receive water from a water inlet, a spinner mounted for rotational motion within said chamber and positioned to receive all water entering through said central opening, said spinner being adapted to discharge said water into said chamber in a direction to rotate said spinner, vanes associated with said spinner to be rotated thereby, said vanes being positioned above and adjacent to said rotatable dial plate and being dimensioned so as to periodically cut water passing from said chamber through the holes to create a pulsating motion in said water, whereby said shower head may provide a pulsating stream of water from said larger holes and a steady stream of water from said finer holes and permit the user to select the type stream desired.

2. A shower head as in claim 1 in which said channel diverges in the direction relative to said water flow so as to reduce said pulsating motion in said water.

3. A shower head as in claim 1 in which said dial plate openings are located at 90° intervals, said larger outlet holes are located at 90° intervals, and said channels are between said larger outlet holes.

4. A shower head as in claim 3 including ribs on said face plate defining said channels and separating said channels from said larger outlet holes.

5. A shower head as in claim 1 in which said means for rotating said dial plate is a control arm secured to dial plate centrally thereof.

6. A shower head as in claim 5 in which said control arm is spring-pressed to said dial plate and including a brush adapted to be held in position over said face plate by insertion between said control arm and said face plate.

7. A shower head capable of producing a pulsed output, if desired, said shower head including a housing having a water inlet, an outer cover forming part of said housing and having holes therein forming a water outlet, the holes in said outer cover forming two sets, one set for pulsed and one set for steady-stream water, a plenum chamber within said housing to receive all the water entering said inlet and to dispense all the water leaving said water outlet, said chamber having an inlet opening and an outlet opening, a spinner within said chamber to periodically close said outlet opening to cause pulsation in said water, said spinner being actuated by water entering said inlet opening, means directing said pulsed water to at least some of the holes in said outer cover, and means for removing the pulses from the water going to one of said sets, whereby all of the water used by said shower head passes through said plenum chamber and all is pulsed as it leaves said chamber.

8. A shower head as in claim 7 in which the means for removing the pulses includes a channel leading to the set of holes for steady stream water, said channel being so dimensioned relative to said water flow as to have a pulse-reducing effect on said flow.

9. A shower head as in claim 8 in which said channel has an increasing cross-sectional area in the direction corresponding to water flow.

10. A shower head as in claim 8 including control means for directing water to one or the other of said two sets of holes and in which the holes in the set for pulsed water are larger than the holes in the other set.

11. A shower head as in claim 7 in which said sets of holes for pulsed water are positioned 90° apart on said outer cover.

12. In a shower head adapted for alternately dispensing a fine steady spray and a heavy pulsating spray, said shower head including a housing having a water inlet opening and an outer circular face plate including fine peripheral outlet holes and large inner holes, that improvement including, a control plate inside said housing and mounted (1) contiguous with the inner surface of said face plate and (2) for motion relative to said face plate, said control plate including a plurality of control holes mounted radially inwardly from said peripheral holes, said control plate and said face plate together defining at least one channel leading from said control holes to said peripheral outlets when said control plate is in one position, said control holes connecting with said large inner holes when said control plate is in another position, a plenum chamber positioned within said housing to receive water and deliver same to said control holes, and means for periodically pulsing said water as it enters said control holes, whereby steady or pulsating spray may be delivered depending upon the position of said control plate.

13. In a shower head as in claim 12 in which said channel diverges in the direction of water flow.

14. In a shower head as in claim 12 in which there are a plurality of channels spaced between said large inner holes, said channels being formed by ribs positioned about said holes, and said channels having increasing cross-sectional area in the direction of water flow.

15. In a shower head as in claim 12 in which said control plate is circular and is positionable by rotation thereof.

16. A shower head for dispensing water in either steady or pulsed streams, including a housing with a water inlet, a round face plate on said housing having small holes about its perimeter and a plurality of sets of large holes located inwardly of said small holes, vanes for periodically interrupting all the water entering said housing to make it pulsating, a multi-position control plate between said vanes and said face plate, said control plate having openings therein to receive said pulsating water, said openings being so located as to direct said pulsating water to said sets of large holes when said control plate is in one position, de-pulsing channels formed between said control plate and said face plate leading between said control plate openings and said small holes when said control plate is in a different position, and means for moving said control plate from one of said positions to the other of said positions, whereby the user may receive either steady or pulsed streams of water from said shower head.

17. A shower head as in claim 16 in which said de-pulsing channels are dimensioned to cause an averaging effect upon said pulsed water flow.

18. A shower head as in claim 16 in which said de-pulsing channels diverge in the direction of water flow.

* * * * *